United States Patent [19]

Stein

[11] Patent Number: 4,476,885

[45] Date of Patent: Oct. 16, 1984

[54] ADJUSTABLE CRUTCH

[76] Inventor: Joseph L. Stein, 9551 Old Creek Dr., Fairfax, Va. 22032

[21] Appl. No.: 432,093

[22] Filed: Sep. 30, 1982

[51] Int. Cl.[3] ..... A61H 3/00

[52] U.S. Cl. ..... 135/69; 135/72

[58] Field of Search ..... 135/69, 72, 75, 68, 135/76

[56] References Cited

U.S. PATENT DOCUMENTS

| | | | |
|---|---|---|---|
| 1,499,458 | 7/1924 | Hughes | 135/69 |
| 2,474,722 | 6/1949 | Blume | 135/69 |
| 3,730,198 | 5/1973 | Johnston et al. | 135/69 |

*Primary Examiner*—Robert A. Hafer
*Assistant Examiner*—Arnold W. Kramer
*Attorney, Agent, or Firm*—Browdy and Neimark

[57] ABSTRACT

An improved crutch made up of three sections which quickly assemble and disassemble and adjust handle height using no nuts and bolts. The middle portion between the upper underarm support and the lower ground contact portions, has a pair of cross bars, the upper movable one of which is the handle. A pair of spring-loaded telescoping members mounts the handle on the lower fixed cross bar. Manipulation of the handle and the telescoping members permits one or both of handle height adjustment and/or assembly or disassembly in a single operation.

6 Claims, 7 Drawing Figures

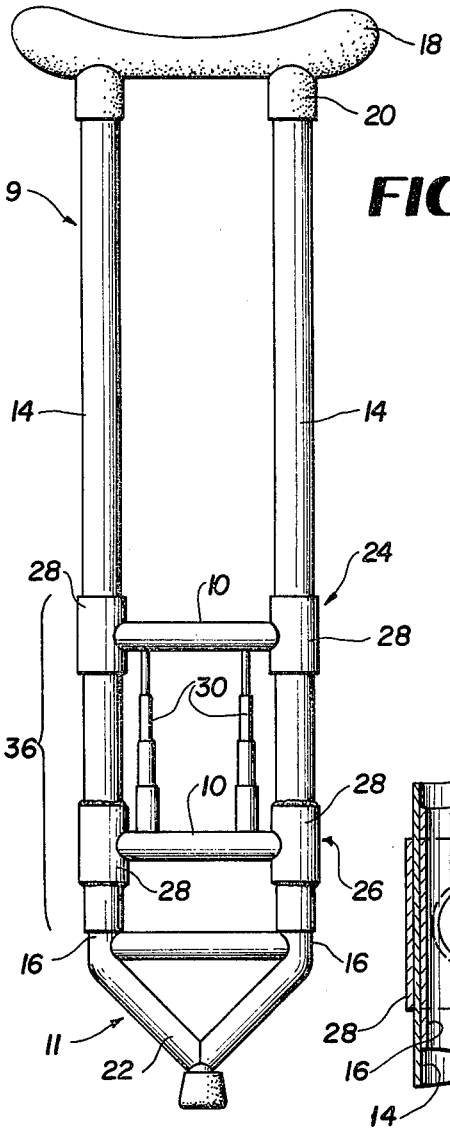
FIG.1
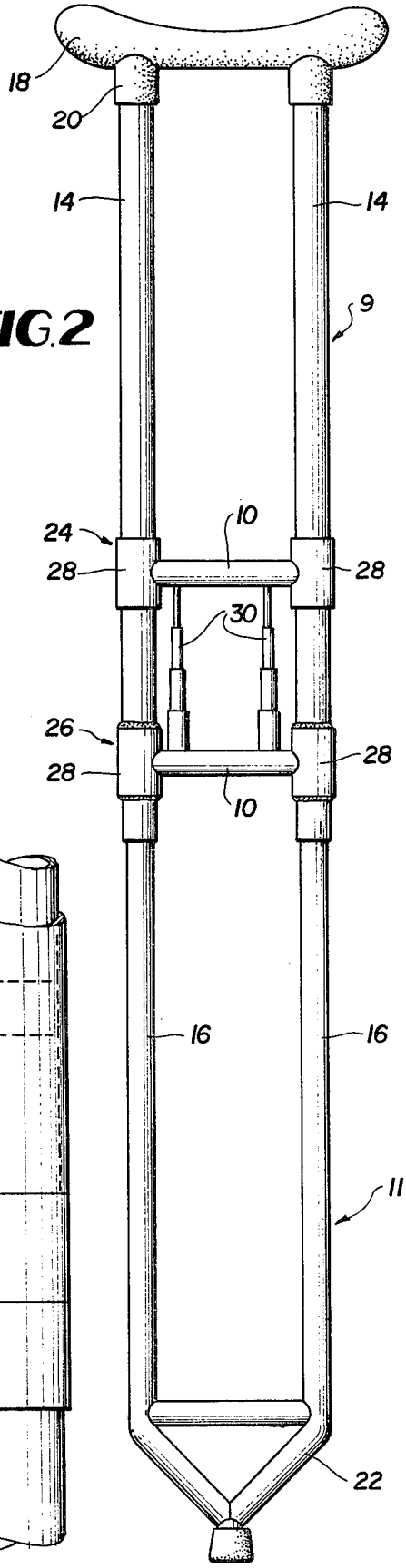
FIG.2
FIG.5
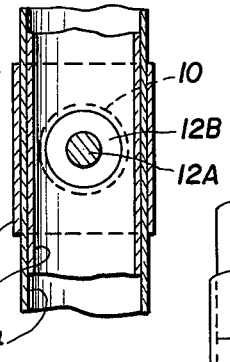
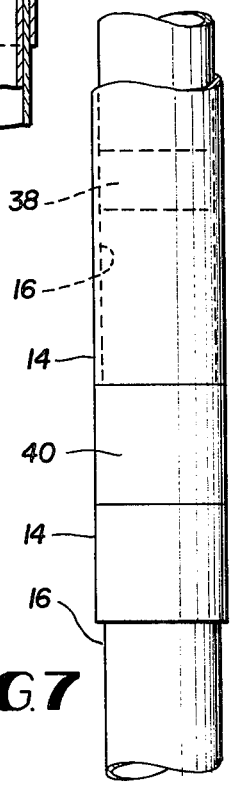
FIG.7
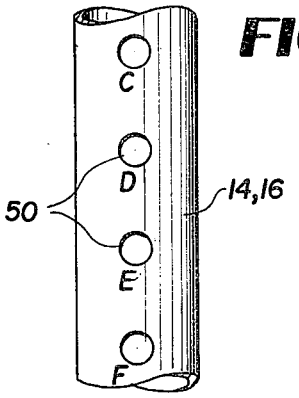
FIG.6

ADJUSTABLE CRUTCH

FIELD OF THE INVENTION

The present invention relates to improved orthopedic equipment, and, more particularly to adjustable crutches which may be adapted to accommodate users having different heights and different lengths of reach and, moreover, may be collapsed.

BACKGROUND OF THE INVENTION

U.S. Pat. No. 885,339 of Apr. 21, 1908 to Hargrove discloses an adjustable crutch arrangement including adjustable hand grip means as well as means to regulate the height of the crutch. The task of adjusting and re-adjusting the crutch arrangement to accommodate a particular user's height and reach is done through the assembly and disassembly of the nut and bolt devices, which is often very cumbersome and difficult. This method of adjustment lacks quickness and reliability for the user when e.g. getting out of an automobile.

In addition, the device of this patent incorporates independent adjustment means, one adjustment for the handle arrangement and another adjustment for regulating the height of the crutch, which also prevents the user from making quick adjustments. Moreover, the handle adjustment feature depends on a series of external notched ribs which make the construction unduly complex and expensive, and which additionally are subject to damage and breakage.

Other adjustable crutches are shown in the patents to Gordon, U.S. Pat. No. 45,242 of 1864; Blume U.S. Pat. No. 2,474,722; Jacobucci U.S. Pat. No. 2,172,047; Shadell et al U.S. Pat. No. 987,497 and Drew U.S. Pat. No. 705,741.

SUMMARY OF THE INVENTION

Accordingly, it is an object of the present invention to improve prior art crutches as indicated above.

It is another object to ease the burden of patients using crutches.

It is a further object of the present invention to provide an improved adjustable crutch arrangement which may be easily and quickly adjusted to accommodate a particular user's height and reach.

It is still another object of the present invention to provide a construction for an adjustable crutch of such an arrangement which incorporates a single adjustment means for independently providing both easy regulation of the handle grip height and the overall length of the crutch.

It is yet another object of the present invention to provide an improved crutch equipped with a more reliable and sturdy height adjustment device.

It is still a further object of the present invention to provide a quality height-adjustable crutch of reliable and not unduly expensive construction which eliminates the use of nut and bolt devices.

It is still a further object of the present invention to provide a construction for an adjustable crutch of such an arrangement that will be generally more reliable, dependable and sturdy than crutches heretofore available.

Another object is to provide a crutch of the character described wherein the hand grip portion remains in position during both the collapsing and extending operations of the crutch, and in which only one step is required to release the parts to permit the crutch to be collapsed.

These and other objects and the nature and advantages of the present invention will be better understood with reference to the following description of specific embodiments of the present invention as illustrated in the accompanying drawings.

BRIEF DESCRIPTION OF THE DRAWINGS

In the accompanying drawings in which the same reference numerals designate the same parts in all views:

FIG. 1 is a front elevational view of an adjustable crutch according to the present invention shown in its collapsed position;

FIG. 2 is a front elevational view of an adjustable crutch according to the present invention shown in its extended position;

FIG. 5 is a cross-sectional view of the handle arrangement in FIG. 4 taken substantially along line 5—5 of FIG. 4;

FIG. 6 is a fragmentary view showing the holes formed on the inside of a leg portion of an adjustable crutch according to the present invention; and FIG. 7 is a schematic view, showing the construction of a protective plastic sleeve of an adjustable crutch according to the present invention.

DESCRIPTION OF THE PREFERRED EMBODIMENT

Figure 3:
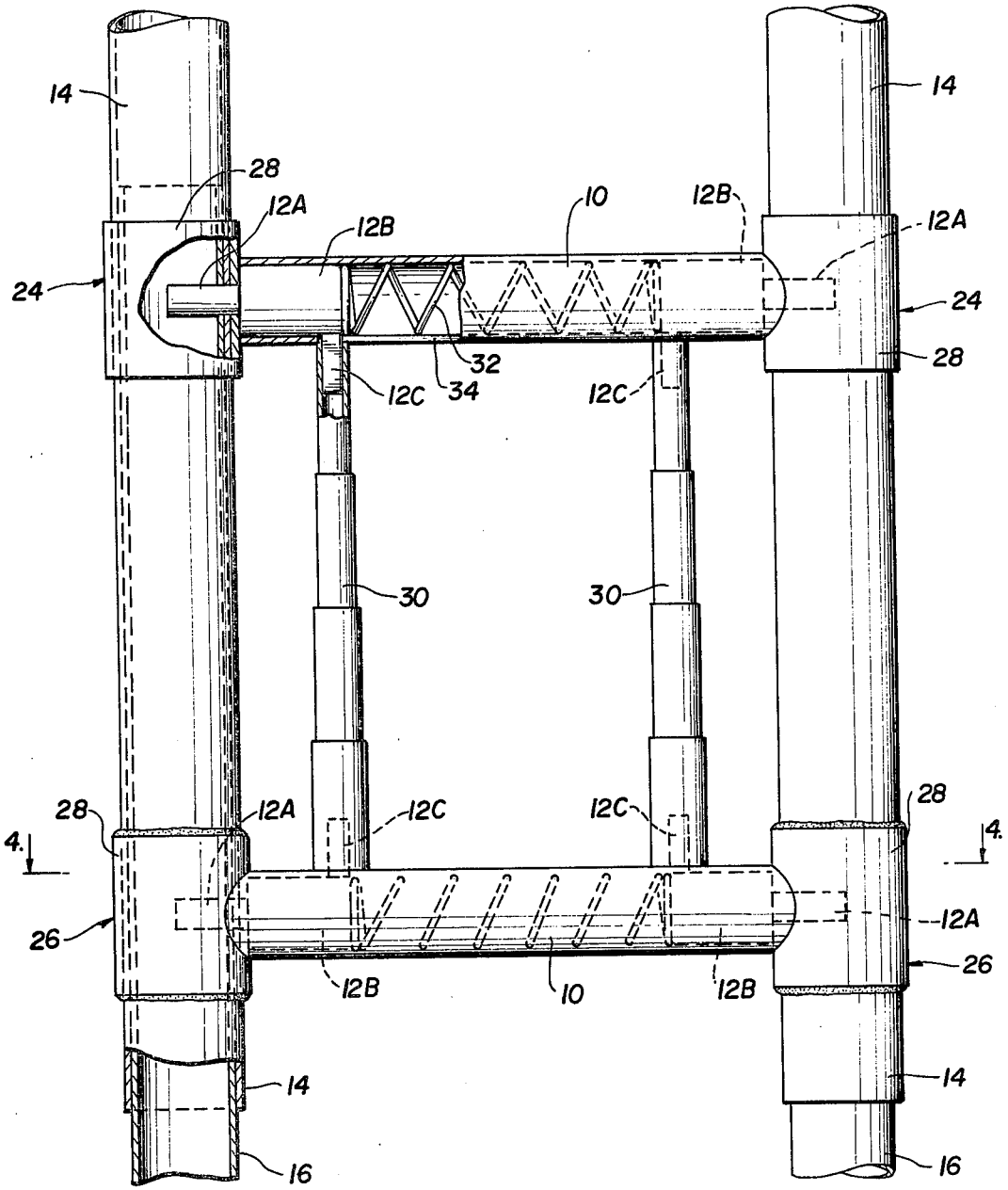
FIG. 3 is a schematic view, partly broken away, showing the construction of the handle arrangement of an adjustable crutch according to the present invention.

Referring now more particularly to the drawings, an adjustable crutch arrangement according to the present invention may be seen in FIGS. 1, 2 and 3 as comprising essentially three body portions, namely a top portion 9, a middle portion 36, and a bottom portion 11.

The middle portion 36 includes means to permit quick release adjustment and assembly of the upper portion 9 and the lower portion 11, as well as simultaneous adjustment of the handle or hand grip contained in portion 36, all as will be set forth in detail below.

The top portion 9 includes two hollow tubular members 14, 14 made of aluminum or any other suitable material spaced in parallel relationship to each other, and joined together at their tops by means of extensions 20 of a molded plastic arm rest 18, which extensions 20 fit tightly over or within the upper ends of the tubular members 14, 14. The parts 18 and 20 may be of the standard form of underarm support used in crutches. The lower ends of tubes 14 are mounted securely, as by welding, to a stationary bar 26 forming part of the middle assembly 36.

The middle portion 36 incorporates a slidably mounted handle grip 24 mounted perpendicular to tubular members 14, 14 and which comprise sleeve members 28 connected to both ends of grip 24 to facilitate easy upward and downward movement of the grip 24, when released, on tubular portions 14. Joined to handle grip 24 is the welded stationary bar 26 which is cooperable with the movable handle grip 24 by means of two telescoping members 30, 30 arranged perpendicularly to the handle grip and stationary bars 24 and 26, respectively. The telescoping members 30 are spaced in parallel relationship to each other. It should be understood that in an another embodiment, the stationary bar 26 can be adapted to move vertically upward or downward along tubular members 14, 14 by mean of its sleeves 28. Another feature of the invention is that parts 24 and 26 are identical, which reduces the cost of manufacture of these parts, although 26 is welded in place and 24 is movable in the preferred embodiment.

The bottom portion 11, as can be seen in FIG. 2, is provided with two hollow tubular members 16, 16 spaced in parallel relationship to each other and joined at their lower ends by a triangular bottom section 22 of tubing similar in diameter to tubular members 16, 16 to form an otherwise more or less conventional foot or bottom portion of the invention crutch. The upper ends of tubular members 16, 16 are snugly and slidingly received in the open bottom ends of the tubular portions 14 and in the sleeve 28 of the stationary bar 26, so that the tubular members 16, 16 may slide freely therein and be adjustably fixed with respect thereto.

The entire middle portion 36 is carried on the upper portion 9 in the embodiment shown. This simplifies adjustment of handle 24, as explained below. Both members 14 and 16 in the dual invention construction are formed with adjustment and locking holes which register with each other, see FIG. 6 and further explanation below.

Figure 4:
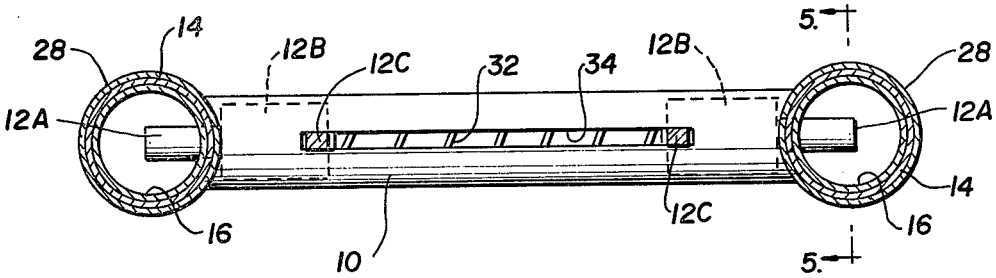
FIG. 4 is a sectional view of the handle arrangement in FIG. 3 taken substantially along line 4—4 of FIG. 3.

The detailed construction of the middle portion 36 can best be seen in FIGS. 3, 4, and 5, wherein the handle grip and stationary bars 24 and 26 respectively are each seen to comprise a tubular member 10 provided with an assembly of locking mechanisms. Each locking mechanism comprises a coiled compression spring 32 fitted inside the tubular member 10 and a pair of locking members 12 slidably mounted in the respective tubular member one at each end of the spring 32. Due to the force exerted by the spring 32, the locking pin portions 12-A of each locking member 12 maintain an outwardly extending thrust into apertures 50 formed in the leg portions 14, 16 (see FIG. 6).

Each locking member 12 is of generally L-shaped configuration and essentially includes three different integral portions of different dimensions. The largest portion 12-B is slightly smaller than tube 10 to allow its free sliding movement therein. Portion 12-B is coaxially casted with the pin portion 12-A protruding horizontally from the largest portion 12-B (see FIG. 5) to fit into the apertures 50 formed in the leg portions 40, 16. Finally, each member 12 comprises a portion 12-C at right angles to portions 12-A and 12-B, and formed at the end of portion 12-B opposite the location of portion 12-A thereon. Portions 12-C cooperate with a pair of spring-loaded telescoping members 30, 30. The telescoping members 30, 30 are fitted at each of their ends to the portions 12-C, which reciprocate in a longitudinal groove provided in tubular member 10. Compression of the telescoping members 30, 30 along their axes permits adjustment of the handle in the middle portion 36, as described below.

Referring now to FIG. 7, thin plastic sleeves 38, 40, which may also be made of metal, wood or any other suitable material, are attached in closely spaced relation to the end of tubular members 14, 16 to provide protection against overextension and instability which might be caused by an insufficient overlapping of the supports.

OPERATION

In operation, the user, upon requiring adjustability to the crutch, may squeeze the telescopic members 30, 30 together by means of the longitudinal grooves 32 formed in the bars 10 (see FIG. 4) moving locking elements 12 from their locked positions shown in FIG. 3 to a compressed position to retract portions 12-A from the apertures 50 provided in the leg portions 16, 16, thus permitting the user to lengthen or shorten the crutch assembly. The handle grip 24, at this same time, can be moved with respect to fixed lower bar 26 to adjust the handle position by means of compression or extension of the telescoping members 30, 30 in a single operation.

Thus, by squeezing the two telescoping members together, all four locking element portions 12-A are disengaged from the registered holes 50 in the main members 14 and 16. The lower member 26 is fixed in place so no action occurs at that location. The disengagement in the upper member 26 releases the upper and lower halves from each other to disassemble the clutch and/or to adjust its height. At this same time with the members 12-A disengaged from their holes, the handle position member 24 with respect to the lower part of the clutch can be adjusted by means of compression or extension of members 30. Thereafter, re-registration of portions 12-A in the assembled and adjusted portions of the fitted together tubular members 14 and 16 and handle 24 renders the crutch ready for use in a single action. The letters in FIG. 6 are illustrative of numbers or other indicia which can be provided as a guide to the various possible adjusted portions of the two parts of the invention crutch.

The lower members 12 serve only the assembling and not the handle adjusting function, but are provided for economy of manufacture, i.e. the same part is used four times rather than two parts two times each.

It should be understood that while an embodiment of the present invention has been illustrated and described herein, numerous other variations or modifications therein may occur to those having skill in this art and what is intended to be covered herein, is not only the illustrated form of the present invention, but also any and all modified forms thereof as may come within the spirit of the invention and the scope of the appended claims.

What is claimed is:

1. An adjustable crutch assembly comprising an upper portion, a lower portion and a middle locking, adjustment and handle assembly mounted on said upper portion, said crutch assembly being of dual tubular construction with the upper ends of two main tubes of the lower portion being telescopically fitted into the open lower ends of two main tubes of the upper portion and of the middle assembly, said middle assembly comprising a lower cross member fixed to and adjacent the ends of said main tubes of said upper portion and an upper cross member slidably mounted on said main tubes of said upper portion, said upper member comprising an adjustable height handle of said crutch assembly, extendable means interconnecting said upper and lower cross members; and interlock means associated with each cross-member for adjustably and simultaneously joining said upper and lower crutch portions together in any one of a plurality of selected adjusted positions with respect to each other, and said upper cross member with respect to said lower cross member and with respect to said upper and lower crutch portions in any one of said selected adjustable positions; whereby simultaneous operation of said interconnecting means and of said interlock means permits either assembly or disassembly of said crutch overall or height adjustment of said crutch coupled with simultaneous adjustment of the height of said handle in said middle assembly both in a single action.

2. The combination of claim 1, wherein said interconnecting means comprises a pair of spring-loaded telescoping members mounted between said upper and lower cross members, and said spring-loaded telescoping members normally urging said upper member away from said lower member.

3. The crutch of claim 1 or claim 2, wherein said upper and lower members are each of tubular construction, means to join the ends of said upper member to a pair of sleeve members, means to slidably mount said sleeve members on the main tubes of said upper crutch portion, said interlock means comprising four locking members mounted one in each end of said upper and lower members of said middle assembly, compression spring means in the tube of each of said upper and lower members normally urging said pair of locking members therein outwardly with respect to each other towards the main tubes of said upper crutch portion, each of said locking members comprising three integral portions, said three integral portions comprising a first body portion slidably and snugly fitted within the tube of said upper or lower member, a second portion extending radially outwardly of said tube for cooperation with said interconnecting means, said tube being formed with a slot for snugly and slidably receiving said second portions, and each of said locking members further comprising an axially extending locking portion extending outwardly of the outer end of said body member towards said main tubes of said upper and lower crutch portions, and said main tubes of said upper and lower crutch portions being formed with an array of registering openings cooperable with said third locking portions of said locking members.

4. The crutch of claim 3, wherein said upper and lower crutch portions, said cross members, and said sleeve members at the end of said cross members are all formed substantially entirely of aluminum tubing.

5. The crutch assembly of claim 1, wherein said upper crutch portion comprises an underarm supporting portion and said lower crutch portion comprises a ground contacting supporting portion.

6. The crutch assembly of claim 3, wherein said entire crutch assembly, including said interconnecting means and said interlock means, is free of any nut and bolt-type structures operated during the steps of assembly, disassembly, height adjustment or handle height adjustment of said crutch assembly.

* * * * *